US009637860B2

(12) United States Patent
Miyazawa

(10) Patent No.: US 9,637,860 B2
(45) Date of Patent: May 2, 2017

(54) SHEET MANUFACTURING APPARATUS

(71) Applicant: SEIKO EPSON CORPORATION, Tokyo (JP)

(72) Inventor: Kazuma Miyazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/678,494

(22) Filed: Apr. 3, 2015

(65) Prior Publication Data

US 2015/0292153 A1 Oct. 15, 2015

(30) Foreign Application Priority Data

Apr. 9, 2014 (JP) ..... 2014-079965

(51) Int. Cl.

| | |
|---|---|
| ***D21D 5/24*** | (2006.01) |
| ***D21D 5/06*** | (2006.01) |
| ***D21B 1/06*** | (2006.01) |
| ***B27N 3/04*** | (2006.01) |
| ***B07B 1/26*** | (2006.01) |

(52) U.S. Cl.

CPC ..... *D21D 5/24* (2013.01); *B07B 1/26* (2013.01); *B27N 3/04* (2013.01); *D21D 5/06* (2013.01)

(58) Field of Classification Search

CPC .. D21D 5/24; D21D 5/00; D21D 5/16; D21D 5/18; D21D 5/20; D21D 1/00; D21D 5/06; B27N 3/04; B27N 3/12; D21H 1/14; D21H 25/005; D04H 1/732; D04H 1/26; A61F 2013/530007; B07B 9/00; B07B 1/00; D21C 5/025; D21B 1/08; D21B 1/028; D21B 1/063; D21B 1/32; D21B 1/06

See application file for complete search history.

(56) References Cited

U.S. PATENT DOCUMENTS 2,646,381 A * 7/1953 Duvall ..... B27N 1/00 19/0.58
2,972,171 A * 2/1961 Heritage ..... D21D 5/00 162/55
3,418,095 A * 12/1968 Kleist ..... C03B 37/06 264/12
3,611,508 A * 10/1971 Reinhall et al. ..... D04H 1/425 19/303
3,717,905 A * 2/1973 Furbeck ..... A61F 13/15626 19/148

(Continued)

FOREIGN PATENT DOCUMENTS

GB 1368889 A * 10/1974 ..... B01D 33/073
JP CA 2331472 A1 * 8/2001 ..... D21D 5/026

(Continued)

*Primary Examiner* — Jose Fortuna
(74) *Attorney, Agent, or Firm* — Global IP Counselors, LLP

(57) ABSTRACT

A sheet manufacturing apparatus includes a defibrating unit configured to defibrate a stock material including fibers, a screening unit configured to allow a defibrated material that has been defibrated at the defibrating unit to pass through a plurality of openings, and a forming unit configured to form a sheet by using a passed material that has passed through the openings. The screening unit has a sieve unit having the openings, and a transferring unit that is located below the sieve unit and with which the cross-sectional area of an internal space in a horizontal direction decreases going downward.

7 Claims, 7 Drawing Sheets

(56) References Cited

U.S. PATENT DOCUMENTS 3,928,188 A * 12/1975 Link ..... B07B 4/06 209/250
4,111,799 A * 9/1978 Cancilla ..... B03B 5/56 209/273
4,213,823 A * 7/1980 Wittig ..... D21D 5/026 162/380
4,396,502 A * 8/1983 Justus ..... B01D 29/0063 209/273
4,440,635 A * 4/1984 Reiniger ..... B02C 18/08 209/306
4,606,789 A * 8/1986 Reinhall ..... D21D 5/24 162/23
4,640,810 A * 2/1987 Laursen ..... D04H 1/732 264/121
4,668,339 A * 5/1987 Terry ..... D21B 1/08 162/13
4,880,540 A * 11/1989 Frejborg ..... B01D 29/03 209/273
4,968,417 A * 11/1990 Ahs ..... D21D 5/026 209/273
5,013,405 A * 5/1991 Izard ..... C04B 26/02 162/101
5,324,389 A * 6/1994 Spencer ..... D21B 1/028 162/4
5,405,499 A * 4/1995 Vinson ..... D21F 11/14 162/100
5,437,418 A * 8/1995 Graef ..... A61F 13/15707 241/152.2
5,582,685 A * 12/1996 Vinson ..... D21F 11/14 162/149
5,735,472 A * 4/1998 Serres ..... D21B 1/32 162/4
5,881,887 A * 3/1999 Fongen ..... D21D 5/04 19/204
5,968,315 A * 10/1999 Meinander ..... D21F 1/66 162/55
8,882,965 B2 * 11/2014 Yamagami ..... D21B 1/08 162/261
8,986,505 B2 * 3/2015 Oguchi ..... B07B 1/00 162/259
9,045,857 B2 * 6/2015 Gomi ..... D21B 1/063
9,074,320 B2 * 7/2015 Gomi ..... D21F 3/08
9,174,243 B2 * 11/2015 Nakamura ..... D21D 99/00
9,194,081 B2 * 11/2015 Yamagami ..... D21D 5/24
2004/0231811 A1 * 11/2004 Engstrand ..... D21B 1/12 162/25
2007/0023329 A1 * 2/2007 Sandberg ..... D21D 5/24 209/270
2010/0071864 A1 * 3/2010 Bechard ..... D21C 9/06 162/199
2012/0297560 A1 * 11/2012 Zwick ..... C11D 3/046 15/104.93
2014/0027075 A1 * 1/2014 Yamagami ..... D21B 1/08 162/4
2014/0290887 A1 * 10/2014 Gomi ..... D21B 1/063 162/252
2014/0290889 A1 * 10/2014 Oguchi ..... B07B 1/00 162/259
2014/0374047 A1 * 12/2014 Yamagami ..... D21B 1/08 162/261
2015/0090416 A1 * 4/2015 Nakamura ..... D21D 99/00 162/263
2015/0096702 A1 * 4/2015 Higuchi ..... D21D 5/24 162/261
2015/0096705 A1 * 4/2015 Fujita ..... D21F 9/00 162/348
2015/0176204 A1 * 6/2015 Miyazawa ..... B07B 9/00 162/263
2015/0176205 A1 * 6/2015 Nakamura ..... D21B 1/063 162/261
2015/0184341 A1 * 7/2015 Tanaka ..... D21F 7/00 162/252
2015/0240418 A1 * 8/2015 Oguchi ..... D21D 5/24 162/109
2015/0240422 A1 * 8/2015 Oguchi ..... D21F 9/00 162/202
2015/0247286 A1 * 9/2015 Nagai ..... D21F 7/003 162/261
2015/0252530 A1 * 9/2015 Higuchi ..... D21F 2/00 162/363
2015/0275429 A1 * 10/2015 Higuchi ..... D21F 9/04 162/261
2015/0275430 A1 * 10/2015 Higuchi ..... D21F 9/04 162/261
2015/0275435 A1 * 10/2015 Seki ..... D21H 17/20 162/5
2015/0292153 A1 * 10/2015 Miyazawa ..... D21D 5/24 162/261
2016/0145801 A1 * 5/2016 Fujita ..... B65H 23/02 162/289
2016/0145802 A1 * 5/2016 Higuchi ..... D21F 13/00 162/373
2016/0145803 A1 * 5/2016 Higuchi ..... D21F 1/60 162/357
2016/0221213 A1 * 8/2016 Nakamura ..... B27N 3/02

FOREIGN PATENT DOCUMENTS

JP WO 2012095928 A1 * 7/2012 ..... D21B 1/08
JP 2013-147772 A 8/2013
JP 2013147772 A * 8/2013
WO WO 2010132164 A1 * 11/2010 ..... D21D 5/026

* cited by examiner

SHEET MANUFACTURING APPARATUS

CROSS-REFERENCE TO RELATED APPLICATIONS

This application claims priority to Japanese Patent Application No. 2014-079965 filed on Apr. 9, 2014. The entire disclosure of Japanese Patent Application No. 2014-079965 is hereby incorporated herein by reference.

BACKGROUND

Technical Field

The present invention relates to a sheet manufacturing apparatus.

Related Art

There is a conventionally known method of manufacturing a defibrated material of waste paper in which waste paper is dry-defibrated with a pulp defibrator, the resulting defibrated material of waste paper is transferred to a sieve machine, the transferred defibrated material of waste paper is sieved through a screen provided to the sieve machine, and the sieved defibrated material of waste paper is transferred to the downstream side. In this method of manufacturing, when the defibrated material of waste paper is being transferred from the sieve machine to the downstream side, the defibrated material of waste paper has been transferred by an air flow that is generated by suction upward from the downstream side of the screen with a blower (for example, see Japanese laid-open patent publication No. 2013-147772).

However, a problem has emerged in that even with upward section with a blower from the downstream side of the screen, some of the sieved defibrated material of waste paper attaches to an inner wall surface of the downstream side of the screen in the sieve machine.

SUMMARY

Having been created in order to resolve the above-mentioned problems at least in part, the present invention can be implemented as the aspects and application examples described below.

A sheet manufacturing apparatus as an example of the present application is provided with a defibrating unit configured to defibrate a stock material including fibers, a screening unit configured to allow a defibrated material that has been defibrated at the defibrating unit to pass through a plurality of openings, and a forming unit configured to form a sheet by using a passed material that has passed through the openings. The screening unit has a sieve unit that has the openings, and a transferring unit which is located below the sieve unit and with which a cross-sectional area of an internal space in a horizontal direction decreases going downward.

According to this configuration, the passed material that has passed through the openings of the sieve unit is sent to the transferring unit, which is located below the sieve unit. This transferring unit is such that the cross-sectional area of an internal space in the horizontal direction decreases going downward. That is to say, an inner wall surface of the transferring unit is inclined going from the upper side toward the lower side of the transferring unit. As such, the passed material that has been sent to the transferring unit is transferred while being collected from the upper side toward the lower side of the transferring unit along the inner wall surface. This makes it possible to reduce adhesion of the passed material to a transfer surface.

In the sheet manufacturing apparatus as in the above application example, the screening unit is provided with a blowing unit configured to blow air into an interior of the transferring unit.

The passed material passing through the openings is predominantly defibrated material, and is light-weight and therefore does not transfer well, but according to the above configuration, even light-weight things such as fibers are transferred by the blowing of the air, and therefore adhesion to the transfer surface can be even further reduced.

In the sheet manufacturing apparatus as in the above application example, the air blown from the blowing unit generates an air flow that swirls through the interior of the transferring unit.

According to this configuration, the passed material is transferred by being borne on the air flow that swirls through the interior of the transferring unit. This makes it possible to spread the air flow to a range broader than blowing air along an incline, and therefore makes it possible to even further reduce adhesion to the transfer surface.

In the sheet manufacturing apparatus as in the above application example, the screening unit has a plurality of aforementioned blowing units.

According to this configuration, causing a swirling air flow to flow from the plurality of blowing units makes it possible to blow air to a wide range of the interior of the transferring unit.

In the sheet manufacturing apparatus as in the above application example, an air outlet of the blowing unit is located above a middle section of a vertical direction in a transferring unit.

According to this configuration, positioning the air outlet at the upper side of the transferring unit makes it possible to easily sweep away any passed material that has adhered to the transferring unit.

The sheet manufacturing apparatus as in the above application example further comprises a housing unit covering the sieve unit such that the openings are included in the interior thereof, and a size of a cross-section of an internal space of an upper side end in the vertical direction in the transferring unit is greater than a size of a cross-section of an internal space of a lower side end in the vertical direction in the housing unit.

According to this configuration, the transferring unit is larger than the housing unit and therefore the passed material can be transferred downward without being caught in the transferring unit.

In the sheet manufacturing apparatus as in the above application example, in the horizontal direction, the transferring unit has a protruding section located further outward than the housing unit, and the air outlet is arranged at the protruding section.

According to this configuration, the air outlet is further outward than the housing unit, and therefore the passed material falling through will not accumulate at the air outlet.

BRIEF DESCRIPTION OF THE DRAWINGS

Referring now to the attached drawings which form a part of this original disclosure.

DETAILED DESCRIPTION OF EXEMPLARY EMBODIMENTS

An embodiment of the present invention shall be described below, with reference to the accompanying drawings. In each of the drawings given below, the scale of the respective members and the like has been illustrated differently from the actual scale, in order to increase the size of the respective members and the like to such an extent as to be visually recognizable.

First, the configuration of a sheet manufacturing apparatus shall be described. The sheet manufacturing apparatus is based on, for example, a technique where a stock material (defibration object) Pu such as a pure pulp sheet or waste paper is formed into a new sheet Pr. The sheet manufacturing apparatus as in the present embodiment is provided with a defibrating unit for defibrating a stock material comprising fibers, a screening unit for causing a defibrated material obtained by defibration at the defibrating unit through a plurality of openings, and a forming unit for using passed material that passed through the openings to form a sheet, wherein the screening unit has sieve unit having openings and a transferring unit which is located below the sieve unit and with which the cross-sectional area of an internal space in the horizontal direction decreases going downward. The configuration of the sheet manufacturing apparatus shall be described in greater detail below.

Figure 1:
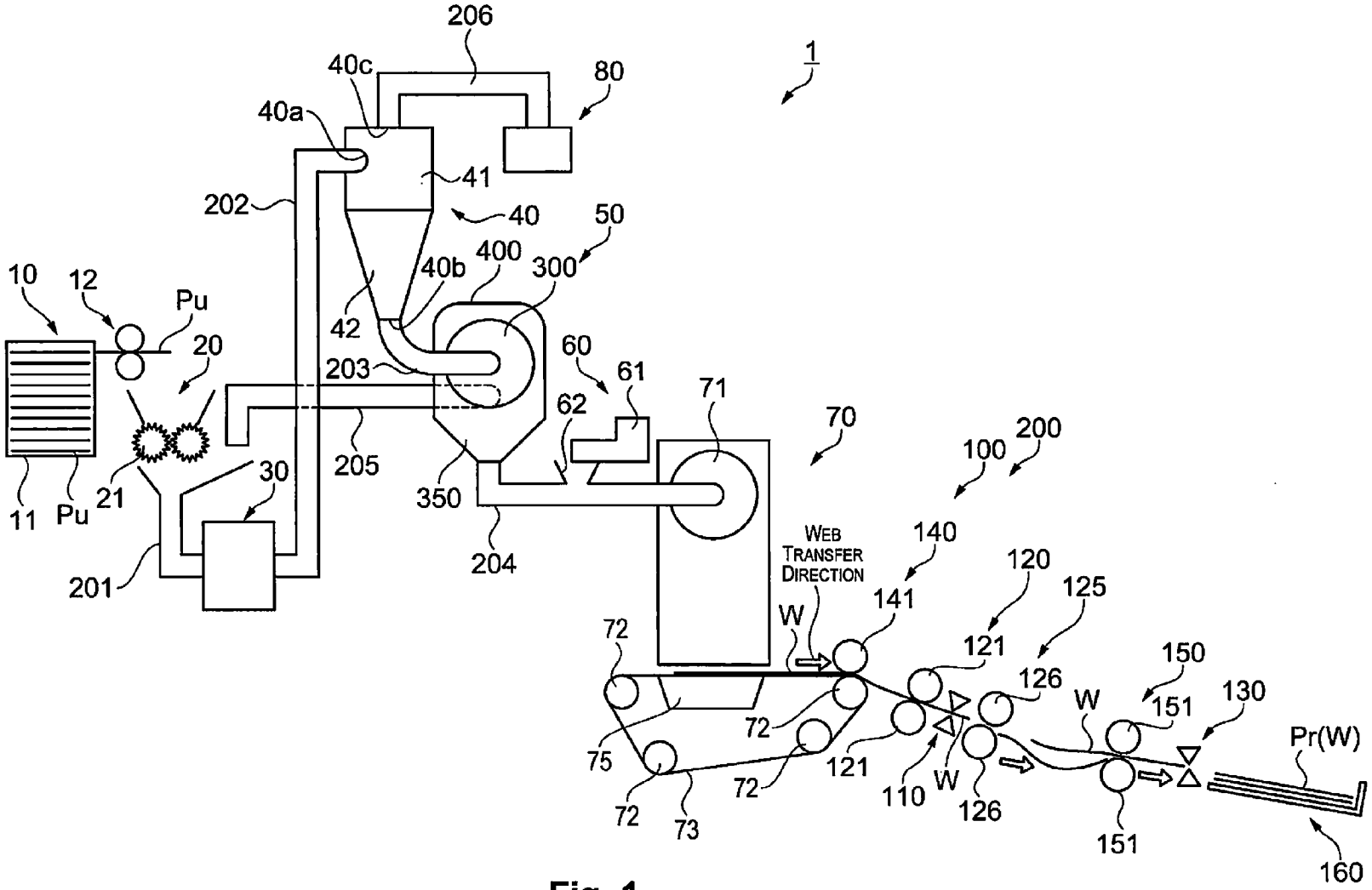
FIG. 1 is a schematic diagram illustrating the configuration of a sheet manufacturing apparatus.

FIG. 1 is a schematic diagram illustrating a configuration of a sheet manufacturing apparatus as in the present embodiment. As illustrated in FIG. 1, a sheet manufacturing apparatus 1 of the present embodiment is provided with, inter alia, a supplying unit 10, a crushing unit 20, a defibrating unit 30, a classifying unit 40, a screening unit 50, an additive agent feeding unit 60, a depositing unit 70, and a forming unit 200. The sheet manufacturing apparatus 1 is also provided with a control unit for controlling these members.

The supplying unit 10 is for supplying waste paper Pu or the like serving as the stock material to the crushing unit 20. The supplying unit 10 is provided, inter alia, with, for example, a tray 11 on which a plurality of sheets of the waste paper Pu are overlaid and accumulated, and an automatic feed mechanism 12 with which the waste paper Pu in the tray 11 can be continuously fed to the crushing unit 20. Examples of the waste paper Pu supplied to the sheet manufacturing apparatus 1 include A4-size paper, which is currently the norm in offices.

The crushing unit 20 is for cutting the waste paper Pu thus supplied into pieces of paper that are several centimeters square. In the crushing unit 20, crushing blades 21 are provided, to constitute such an apparatus as to broaden the cutting width of blades in an ordinary shredder. This makes it possible to easily cut the waste paper Pu thus supplied into pieces of paper. The crushed paper that has been divided is then supplied to the defibrating unit 30 via a tubing 201.

The defibrating unit 30 is provided with a rotary blade that rotates (not shown), and is for performing a defibration by which the crushed paper that is supplied from the crushing unit 20 is disentangled into fibers. In the present application, the term "defibration object" is used to refer to what is defibrated in the defibrating unit 30, and the term "defibrated material" is used to refer to what has passed through the defibrating unit 30. The defibrating unit 30 of the present embodiment is one that performs the defibration dry in air. Printed ink or toner, anti-bleeding materials, or other coating materials on the paper or the like are turned into particles several tens of μm or smaller (hereinafter called "ink particles") and separated from the fibers by the defibration treatment of the defibrating unit 30. As such, the defibrated material exiting from the defibrating unit 30 is ink particles and fibers obtained by defibrating the pieces of paper. Then, there is a mechanism where an air flow is generated by the rotation of the rotary blade, and the fibers that have been defibrated are borne on this air flow via a tubing 202 and transferred in the air to the classifying unit 40. As needed, there may be separately provided an air flow generation apparatus for generating an air flow for transferring, to the classifying unit 40, the fibers that have been defibrated via the tubing 202 to the defibrating unit 30.

The classifying unit 40 is one at which the introduced material that has been introduced is classified by air flow. In the present embodiment, the defibrated material, serving as the introduced material, is classified into the ink particles and the fibers. Applying, for example, a cyclone enables the classifying unit 40 to classify by air flow the fibers that have been transferred into the ink particles and de-inked fibers (de-inked defibrated material). Instead of the cyclone, however, another type of air flow-system classifier may be utilized. In such a case, for example, an elbow jet, eddy classifier, or the like is used as an air flow-system classifier other than the cyclone. The air flow-system classifier is for generating a swirling airflow, and separating and classifying by using differences in the centrifugal force received because of the size and density of the defibrated material, and allows for the classification points to be adjusted by adjusting the airflow speed and centrifugal force. The ink particles, which are smaller and less dense, and the fibers that are larger and denser than the ink particles are thereby divided. The act of removing the ink particles from the fibers is called de-inking.

The classifying unit 40 of the present embodiment is a cyclone of a tangential input format, and is constituted of an introduction port 40*a* at which the introduced material is introduced from the defibrating unit 30, a cylinder part 41 to which the introduction port 40*a* is attached in a tangential direction, a conical part 42 continuous with a lower part of the cylinder part 41, a lower output port 40*b* provided to a lower part of the conical part 42, and an upper exhaust port 40*c* for fine powder discharge provided to the middle of an upper part of the cylinder part 41. The conical part 42 decreases in diameter going vertically downward.

In the classification process, the air flow bearing the defibrated material introduced from the introduction port 40*a* of the classifying unit 40 changes to circumferential movement in the cylinder part 41 and the conical unit 42; this applies a centrifugal force and causes classification to take place. Then, being larger and denser than the ink particles, the fibers move toward the lower output port 40*b* whereas the smaller and less dense ink particles are guided to the upper exhaust port 40*c* as a fine powder along with air, and the de-inking proceeds. A short fiber mixture, which contains a large amount of ink particles, is discharged from the upper exhaust port 40*c* of the classifying unit 40. The discharged short fiber mixture containing a large amount of ink particles is collected at a receiving unit 80 via a tubing 206 connected to the upper exhaust port 40*c* of the classifying unit 40. Classified material, including fibers, that has been classified is transferred in the air toward the screening unit 50 via a tubing 203 from the lower output port 40*b* of the classifying unit 40. The classified material may be transferred from the classifying unit 40 to the screening unit 50 by the air flow from during the classification, or may be transferred by the force of gravity to the screening unit 50, which is below, from the classifying unit 40, which is above. A suction unit for efficiently suctioning the short fiber mixture from the upper exhaust port 40*c*, or the like, may be arranged at the upper exhaust port 40*c* of the classifying unit 40, the tubing 206, or elsewhere.

The screening unit 50 is for screening the classified material (de-inked defibrated material) comprising fibers that has been classified by the classifying unit 40, by allowing the classified material to pass through from a sieve unit 300 having a plurality of openings. More specifically, the screening unit 50 is one at which the classified material comprising fibers classified by the classifying unit 40 is screened into a passed material that passes through the openings and a residual material that does not pass through the openings. The screening unit 50 of the present embodiment is provided with a mechanism for distributing the classified material in the air by a rotating motion. The passed material having been passed through the openings by the screening of the screening unit 50 is then transferred to the depositing unit 70 side via a tubing 204 from a transferring unit 350. The residual material that is not passed through the openings by the screening of the screening unit 50, however, is returned to the defibrating unit 30 as the defibration object again, via a tubing 205. Thus, the residual material is not discarded but instead is reused (reutilized). The configuration of the screening unit 50 shall be described in greater detail below.

The passed material having been passed through the openings by the screening of the screening unit 50 is transferred in the air to the depositing unit 70 via the tubing 204. The passed material may be transferred from the screening unit 50 to the depositing unit 70 by a blower (not shown) for generating an air flow, or may be transferred by the force of gravity from the screening unit 50, which is above, to the depositing unit 70, which is below. Provided between the screening unit 50 and the depositing unit 70 in the tubing 204 is the additive agent feeding unit 60, which adds an additive such as a resin (for example, a fusion-bondable resin or thermosetting resin) to the passed material being transferred. Examples of additives that can be fed in other than a fusion-bondable resin could also include flame retardants, whiteness enhancers, sheet strengtheners, sizing agents, or the like. These additives are retained in an additive agent retaining unit 61 and fed from a feed port 62 by a feeding mechanism (not shown).

The depositing unit 70 is for forming a web W by using the deposited material comprising the resin and passed material comprising fibers that is fed in from the tubing 204. The depositing unit 70 has a mechanism for uniformly dispersing the fibers in the air, and a mechanism for depositing the dispersed fibers onto a mesh belt 73. The "web W" as in the present embodiment refers to a configuration form of an object that comprises fibers and a resin. As such, a case where a mode such as the dimensions or the like is changed during heating, compression, cutting, transfer, or the like of the web would still be illustrative of the web.

First, a forming drum 71 into the interior of which the fibers and resin are fed is arranged in the depositing unit 70 as the mechanism for uniformly dispersing the fibers into the air. Then, rotatingly driving the forming drum 71 makes it possible to uniformly mix the resin (additive agent) into the passed material (fibers). A screen having a plurality of small holes is provided to the forming drum 71. The forming drum 71 can then be rotatingly driven to uniformly mix the resin (additive agent) into the passed material (fibers) and also uniformly distribute, into the air, the fibers or mixture of fibers and resin having passed through the small holes.

Disposed below the forming drum 71 is the endless mesh belt 73, on which is formed a mesh that is stretched by stretching rollers 72. Turning of at least one of the stretching rollers 72 causes the mesh belt 73 to move in one direction.

Also, provided vertically below the forming drum 71 is a suction apparatus 75 serving as a suction unit for generating an air flow oriented vertically downward, with the mesh belt 73 therebetween. The suction apparatus 75 makes it possible to suction the fibers distributed in the air onto the mesh belt 73.

The fibers and the like that pass through the small holes of the screen of the forming drum 71 are deposited onto the mesh belt 73 by the force of suction of the suction apparatus 75. At this time, moving the mesh belt 73 in one direction makes it possible to form a web W that comprises the fibers and the resin and has been deposited in an elongated shape. A continuous strip of the web W is formed by continuously distributing from the forming drum 71 and moving the mesh belt 73. The mesh belt 73 may be made of metal, resin, or a nonwoven fabric, and indeed may be anything provided that the fibers can be deposited and the air flow can be allowed to pass through. When the holes of the mesh belt 73 have too large a diameter, the fibers enter in between the mesh and become irregularities when the web W (sheet) is formed, and when the holes of the mesh have too small a diameter, in turn, it is difficult to form a stable air flow by the suction apparatus 75. For this reason, preferably, the hole diameter of the mesh is adjusted as appropriate. The suction apparatus 75 can be configured by forming an enclosed box that has an open window of a desired size below the mesh belt 73, and suctioning air from outside the window and giving the inside of the box a more negative pressure than the outside air. The "web W" as in the present embodiment refers to a configuration form of an object that comprises fibers and a resin. As such, an instance where there are changes in form such as changes in the dimensions at times such as during heating, compression, cutting, or transfer of the web W would still be indicated as being the web W.

The web W that is formed on the mesh belt 73 is transferred by a transferring unit 100. The transferring unit 100 of the present embodiment illustrates a process of transferring the web W up until ultimately being fed in to a stacker 160 as a sheet Pr (web W) from the mesh belt 73. As such, other than the mesh belt 73, a variety of rollers or the like also function as a part of the transferring unit 100. As the transferring unit, it suffices for there be at least one transferring belt or transferring roller. More specifically, first, the web W that has been formed on the mesh belt 73, which is a part of the transferring unit 100, is transferred in accordance with the direction of transfer (the arrow in the drawing) by the rotational movement of the mesh belt 73. Next, the web W is transferred in accordance with the direction of transfer (the arrow in the drawing) from the mesh belt 73. In the present embodiment, a range where the sheet Pr is formed from the web W having been deposited by the depositing unit 70 on the downstream side of the depositing unit 70 in the direction of transfer of the web W belongs to the forming unit 200.

A pressurizing unit is arranged on the downstream side of the depositing unit 70 in the direction of transfer of the web W. The pressurizing unit of the present embodiment is a pressurizing unit 140 having a roller 141 for applying pressure to the web W. Passing the web between the roller 141 and the stretching rollers 72 makes it possible to apply pressure to the web W. This makes it possible to improve the strength of the web W. j Pre-cutting unit rollers 120 are arranged on the downstream side of the pressurizing unit 140 in the direction of transfer of the web W. The pre-cutting unit rollers 120 have a pair of rollers 121. Of the pair of rollers 121, one is a drive control roller and the other is a driven roller.

A one-way clutch is used for a drive transmission unit for causing the pre-cutting unit rollers 120 to rotate. The one-way clutch has a clutch mechanism for transmitting a rotational force in only one direction, and is configured so as to idle in the opposite direction. This suppresses tension on the web W and makes it possible to prevent the web W from being torn off, because the one-way clutch idles at the pre-cutting unit roller 120 side when an excessive tension is applied to the web W with a speed difference between post-cutting unit rollers 125 and the pre-cutting unit rollers 120.

Arranged on the downstream side of the pre-cutting unit rollers 120 in the direction of the transfer of the web W is a cutting unit 110, which cuts the web W in a direction intersecting with the direction of transfer of the web W being transferred. The cutting unit 110 is provided with a cutter and cuts the continuous web W into leaflets (sheets) in accordance with a position of cutting, which is set to a predetermined length. Applicable examples for the cutting unit 110 include a rotary cutter. According thereto, cutting can be performed while the web W is being transferred. As such, the transfer of the web W is not stopped during cutting, and therefore the manufacturing efficiency can be improved. A variety of cutters other than a rotary cutter may be applied as the cutting unit 110.

The post-cutting unit rollers 125 are arranged on the downstream side in the direction of transfer of the web W from the cutting unit 110. The post-cutting unit rollers 125 have a pair of rollers 126. Of the pair of rollers 126, one is a drive control roller and the other is a driven roller.

In the present embodiment, tension can be applied to the web W by a speed difference between the pre-cutting unit rollers 120 and the post-cutting unit rollers 125. The configuration is so as to drive the cutting unit 110 and cut the web W in a state where a tension is applied to the web W.

A pair of heating and pressurizing rollers 151 constituting a heating and pressurizing unit 150 are arranged more on the downstream side than the post-cutting unit rollers 125 in the direction of transfer of the web W. The heating and pressurizing unit 150 is one at which the fibers included in the web W are bonded (fixed) to one another with the resin interposed therebetween. A heating member such as a heater is provided to a rotational axis center part of the heating and pressurizing rollers 151, and causing the web W to pass through between the pair of heating and pressurizing rollers 151 makes it possible to heat and apply pressure to the web W being transferred. The heating and compressing of the web W by the pair of heating and pressurizing rollers 151 makes it easier for the resin to melt and become entangled with the fibers, shortens the spacing between fibers, and increases the contact points between fibers. This raises the density and improves the strength of the resulting web W. In the heating and pressurizing unit 150, the heating and compression are carried out so that the web W has about 1/5 to 1/10 the thickness versus the thickness of the web W before the heating and compression treatment.

A post-cutting unit 130 for cutting the web W along the direction of transfer of the web W is arranged more on the downstream side than the heating and pressurizing unit 150 in the direction of transfer of the web W. The post-cutting unit 130 is provided with a cutter and cuts in accordance with a predetermined position of cutting in the direction of transfer of the web W. The sheet Pr (web W) of a desired size is thereby formed. The cut sheet Pr (web W) is then loaded onto the stacker 160, or the like.

The term "sheet" as in the embodiment described above refers to mainly to when sheets are made from the stock material comprising fibers, such as waste paper or pure paper. However, there is no limitation thereto, and the sheet may be in the form of a board, or in the form of a web (or in a shape that is uneven). The stock material may also be cellulose or other plant fibers, polyethylene terephthalate (PET), polyester, or other chemical fibers, or wool, silk, or other animal fibers. In the present application, the "sheets" would be divided in paper and non-woven material. Paper encompasses forms made into thin sheets and the like, and encompasses recording paper intended for writing or printing, or wallpaper, wrapping paper, colored paper, Kent paper, and the like. Non-woven materials are thinner and have less strength than paper, and encompass non-woven materials, fiber board, tissue paper, kitchen paper, cleaners, filters, liquid-absorbing materials, sound-absorbing materials, mats, and the like.

In the present embodiment, "waste paper" refers primarily to paper that has been printed on, but any stock material that is formed as paper is regarded as being waste paper, irrespective of whether the stock material has been used or not.

Figure 2:
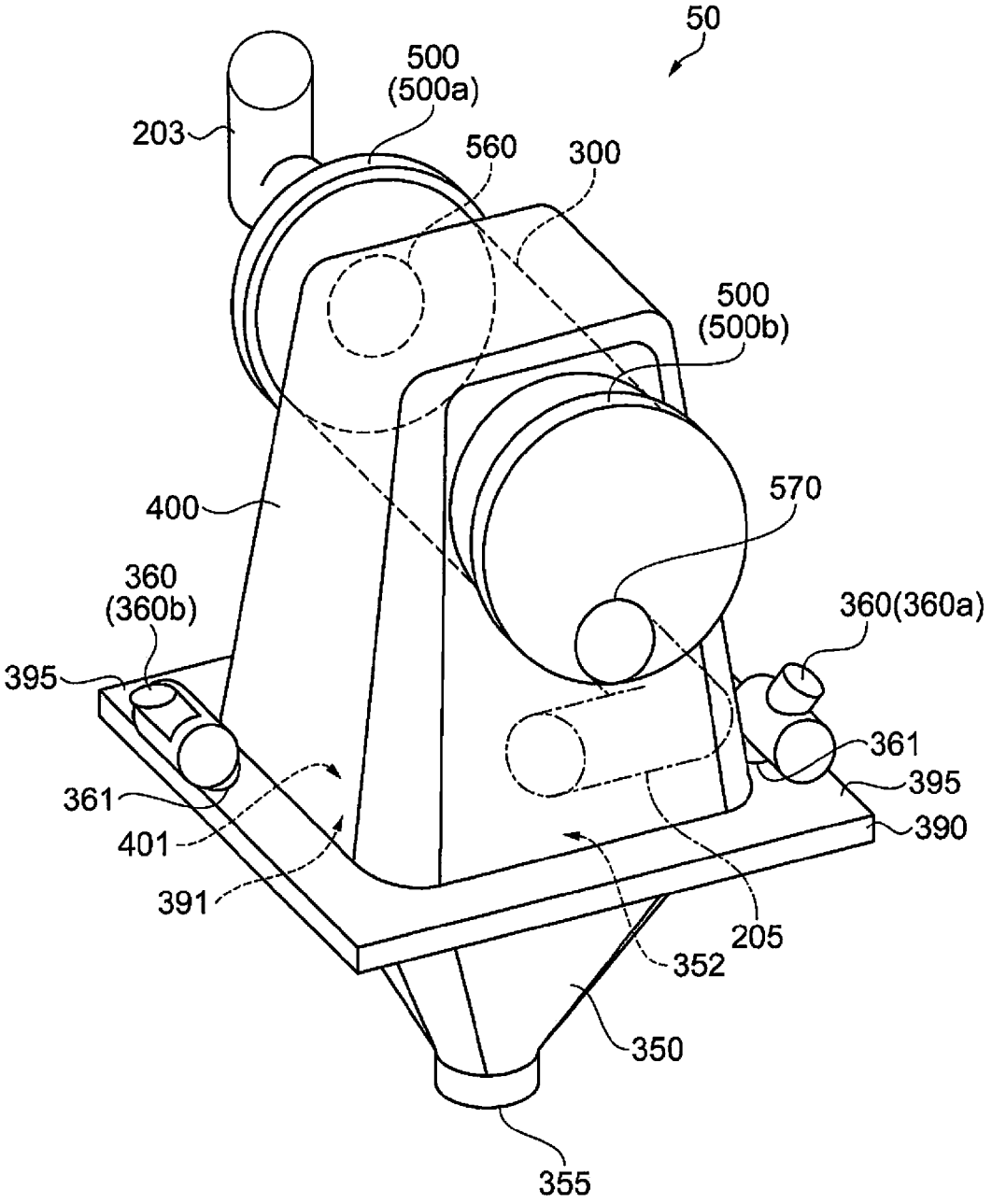
FIG. 2 is a schematic diagram illustrating the configuration of a screening unit.
Figure 3A:
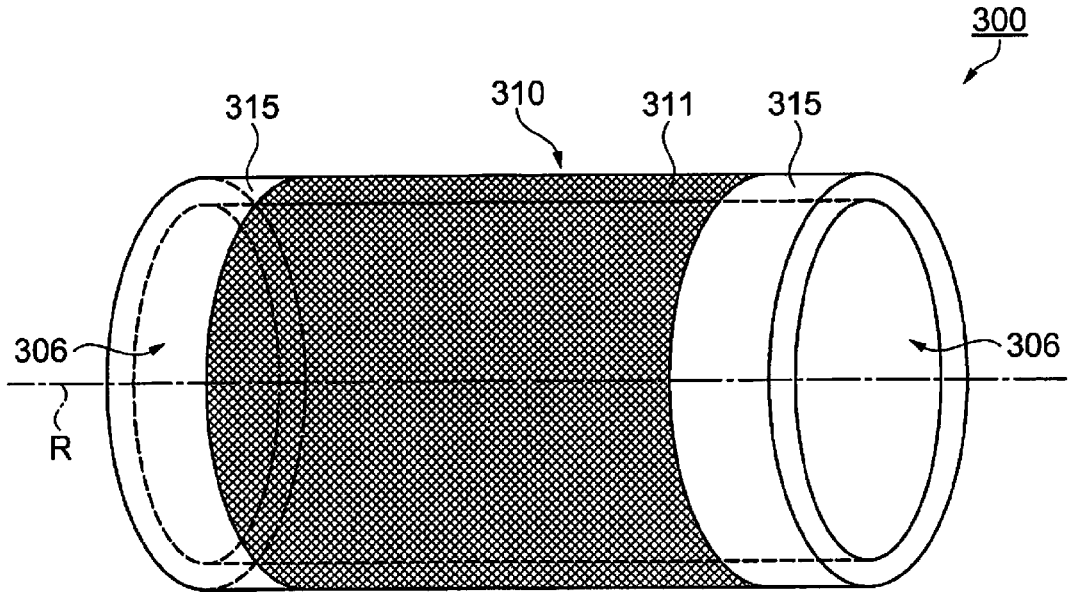
FIGS. 3A and 3B are schematic diagrams illustrating the configuration of a screening unit.
Figure 3B:
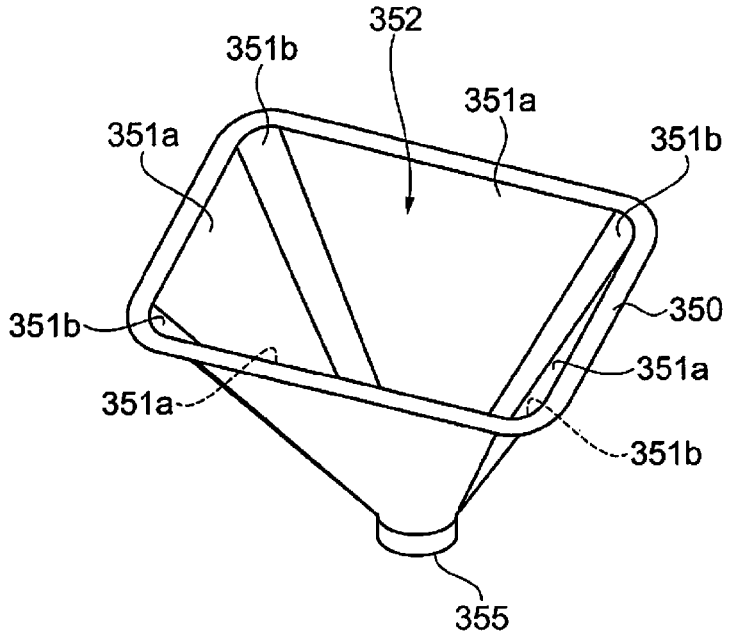
Figure 4:
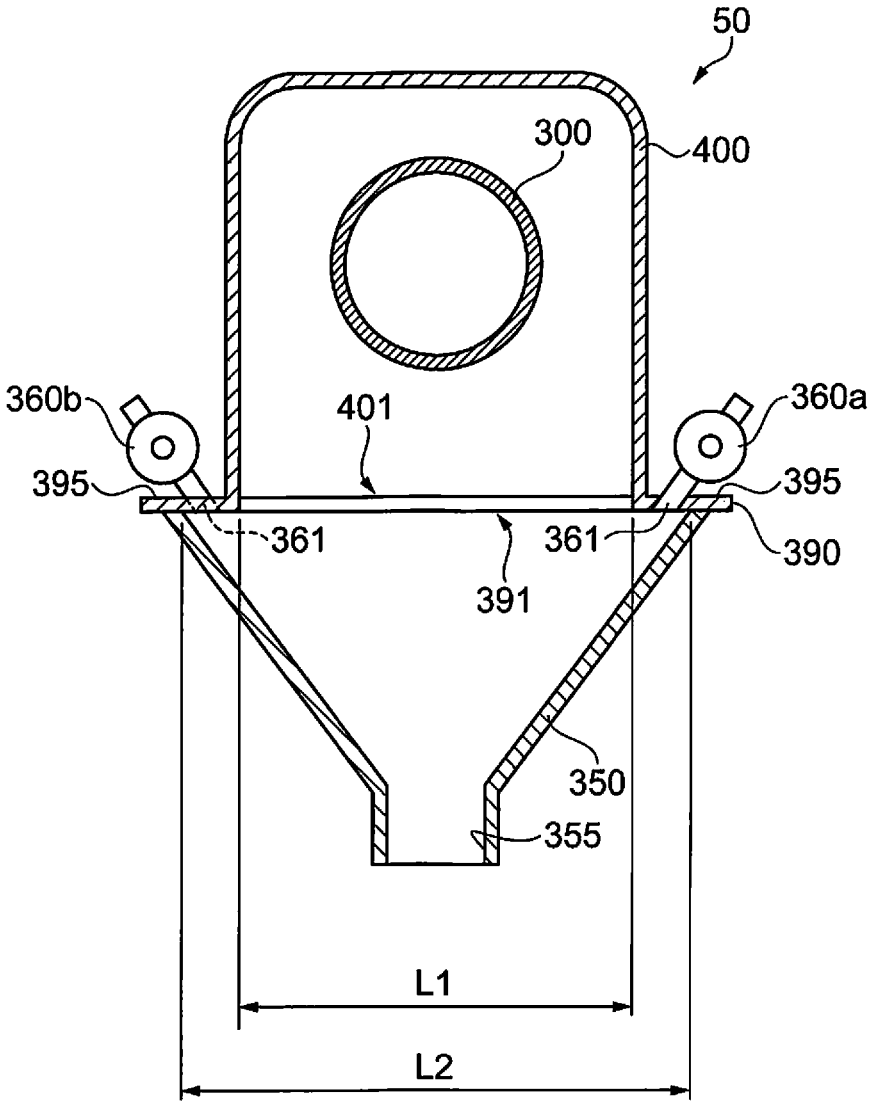
FIG. 4 is a schematic diagram illustrating the configuration of a screening unit.

The configuration of the screening unit shall be described next. FIGS. 2, 3A, 3B and 4 are schematic diagrams illustrating the configuration of the screening unit. FIG. 2 is a perspective view of the screening unit, FIG. 3A is a schematic diagram illustrating the configuration of the sieve unit, and FIG. 3B is a schematic diagram illustrating the configuration of the transferring unit. FIG. 4 is a schematic side view of the screening unit. As illustrated in FIG. 2, the screening unit 50 is provided with the sieve unit 300, the transferring unit 350, and a housing unit 400, inter alia.

As illustrated in FIG. 3A, the sieve unit 300 has an opening unit 310 having a plurality of openings 311 through which materials comprising fibers pass through in the air. The sieve unit 300 of the present embodiment has a drum shape. The sieve unit 300 can be rotated about a rotation center axis R, thereby allowing the material (classified material) to pass through from the openings 311. A cylindrical unit 315 not having any openings 311 is present at both ends of the opening unit 310 in the direction of the rotation center axis R. The opening unit 310 and the cylindrical unit 315 are fastened by welding, a screw, or the like, and rotate integrally. The sieve unit 300 is formed in the shape of a cylindrical using a metal such as stainless steel having a uniform thickness, and open mouths 306 are provided to both ends thereof.

The plurality of openings 311 (perforated metal) are provided to the opening unit 310. The configuration is such that a material comprising fibers that is distributed from the openings 311 passes through, and the size, region of formation, and the like of the openings 311 is set as appropriate depending on the size, type, and so forth of the material comprising fibers. The opening unit 310 is not limited to being perforated metal, and may be a wire mesh material or the like. The plurality of openings 311 have the same size (surface area), and each is arranged at equal intervals. This causes the material passing through the openings 311 to have substantially uniform dimensions. Entangled fibers are also loosened when passing through the openings 311. The cylindrical unit 315 is a portion where there are no openings 311 or the like, and is a portion that is in contact with the housing unit 400.

As illustrated in FIG. 2, the housing unit 400 is for covering the sieve unit 300 so that the openings unit 310 (openings 311) of the sieve unit 300 are included in the interior thereof, and forms a frame body. That is to say, the housing unit 400 partially surrounds the sieve unit 300 so that the opening unit 310 of the sieve unit 300 comes inside the frame body. As such, the opening unit 310 of the sieve unit 300 is arranged within a space on the inside of the housing unit 400. A part of the frame body of the housing unit 400 and the cylindrical units 315 are in contact with one another. This manner of contact between the housing unit 400 and both of the cylindrical units 315, 315 makes it possible to prevent, inter alia, materials comprising fibers having passed through from the openings 311 from diffusing to the outside from the interior of the housing unit 400. Also, the housing unit 400 is arranged on the inside of the sieve unit 300 in the rotation axis direction R of the sieve unit 300, and therefore it is possible to obtain a configuration with which the width dimension of the housing unit 400 is made to be shorter than the width dimension of the sieve unit 300 in the rotation axis direction R of the sieve unit 300, thus making it possible to reduce the scale of the apparatus configuration. A pile seal or the like is provided to the portions where the housing unit 400 and both of the cylindrical units 315, 315 are in contact with one another. This reduces the frictional force between the housing unit 400 and the cylindrical units 315, 315 when the sieve unit 300 is rotated with respect to the housing unit 400, and makes it possible to reduce the rotational load of the sieve unit 300. It is also possible to suppress diffusion of fibers and the like from the interior of the housing unit 400 to the exterior of the housing unit 400. An open mouth 401 at which the lower side of the housing unit 400 is opened is formed, and the passed material that has passed through the openings 311 of the sieve unit 300 is allowed to move to the transferring unit 350 side through the open mouth 401.

As illustrated in FIG. 2, two side units 500 (500*a*, 500*b*) that do not rotate are present at both ends of the sieve unit 300 in the direction of extension and contact of the rotation center axis R. The screening unit 50 is provided with: an introduction port 560 that is provided to one side unit 500*a* and that introduces the material to the sieve unit 300; and a discharge port 570 that is provided to the other side unit 500*b* and is located lower in the vertical direction than the introduction port 560, and that discharges a residual material, which has not passed through the openings 311. The sieve unit 300 is rotatably supported by a support unit (not shown). The sieve unit 300 and the side units 500 are configured so as to be in contact with the cylindrical units 315 of the sieve unit 300. A pile seal or the like is provided to the portions where the side units 500 and the two cylindrical units 315, 315 are in contact with one another. This reduces the frictional force between the side units 500 and the cylindrical units 315, 315 when the sieve unit 300 is rotated with respect to the side units 500, and makes it possible to reduce the rotational load of the sieve unit 300. It is also possible to suppress diffusion of fibers or the like from the interior of the sieve unit 300 to the exterior via the side units 500. The side units 500*a*, 500*b* are fixed to an external frame (not shown). The introduction port 560 is connected to the tubing 203, and the discharge port 570 is connected to the tubing 205.

The transferring unit 350 is provided below the housing unit 400. More specifically, the housing unit 400 and the transferring unit 350 are connected to one another via a connecting plate 390. An opening unit 391 that is either the same size as the open mouth 401 or larger than the open mouth 401 provided to the frame body of the housing unit 400 is provided to the connecting plate 390; the housing unit 400 is connected to one surface of the connecting plate 390 so that the open mouth 401 provided to the frame body of the housing unit 400 and the opening unit 391 of the connecting plate 390 correspond. The transferring unit 350 is connected to the other surface of the connecting plate 390. The transferring unit 350 has an open mouth 352 opening at an upper end side, is located below the sieve unit 300, and is formed so that the cross-sectional area of an internal space in the horizontal direction decreases going downward. That is to say, an inner wall surface of the transferring unit 350 is inclined going from the upper side toward the lower side of the transferring unit 350. As such, while in the process of passing through the transferring unit 350 from the open mouth 352, the passed material that has been sent to the transferring unit 350 is transferred while being collected from the upper side toward the lower side of the transferring unit 350 along the inner wall surface. The open mouth 352 of the transferring unit 350 is larger than the open mouth 401 of the housing unit 400 and larger than the opening unit 391 of the connecting plate 390. Provided to a lowermost section of the transferring unit 350 is a discharge port 355 having an opening for discharging the passed material; the discharge port 355 is connected to the tubing 204.

As illustrated in FIG. 3B, the transferring unit 350 forms substantially a quadrangular pyramid. More specifically, the inner wall surface of the transferring unit 350 has an inner surface section 351 that has four flat surfaces. Provided between the inner surface sections 351*a* are curved surface sections 351*b* having a curved surface that is convex going toward the outside of the transferring unit 350. Having the curved surface sections 351*b* between the inner surface sections 351*a* makes it possible for the fibers and the like to be transferred in an unencumbered manner when the fibers or the like are being transferred in the interior of the transferring unit 350. The transferring unit 350 forms substantially a quadrangular pyramid so as to correspond to the rectangular shape of the housing unit 400, making it possible to reduce the scale as compared to a transferring unit that is conical in shape.

The transferring unit 350 by which the fibers and the like are transferred is preferably formed of a material that is electroconductive. For example, the transferring unit 350 can be formed of, inter alia, a metal, a resin to which electroconductive fibers have been added, or the like. An electrostatic film may be pasted onto the inner surface sections 351*a* or the curved surface sections 351*b*, or the surface of the inner surface sections 351*a* or curved surface sections 351*b* may be subjected to a surface treatment for imparting electroconductivity. Preferably, the surface resistance value of the inner surface sections 351*a* and the curved surface sections 351*b* is not greater than $10^8$ ohms per square (Ω/□). This reduces adhesion of the transferred fibers to the inner surface sections 351*a* or curved surface sections 351*b* due to charging, and makes it possible to more efficiently transfer the fibers and the like.

Figure 5A:
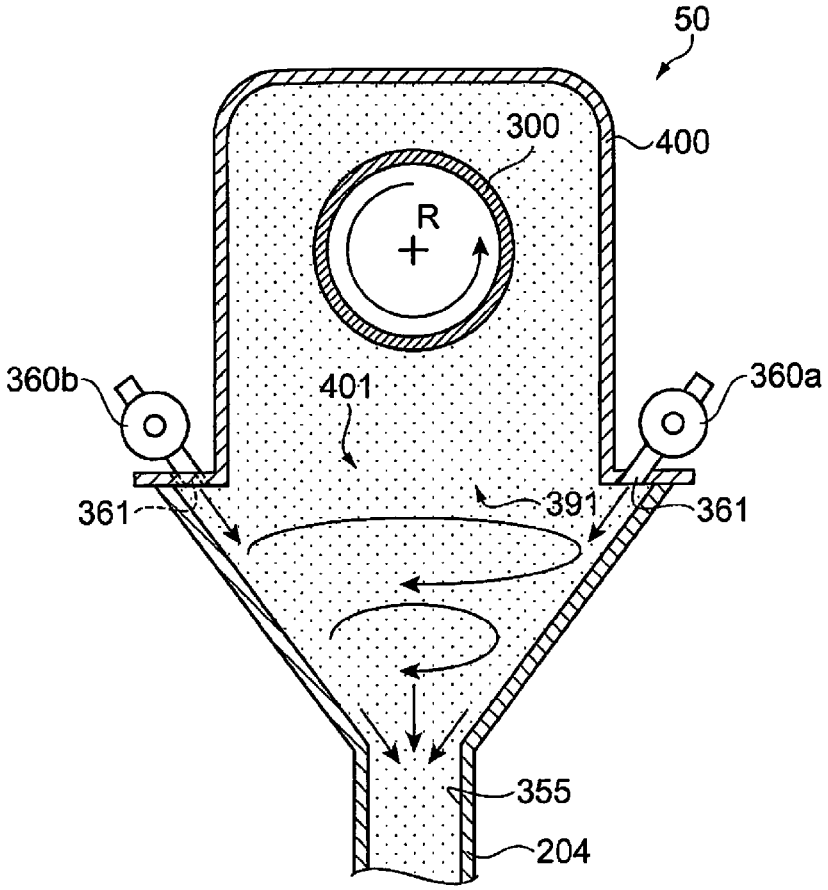
FIGS. 5A and 5B are descriptive diagrams illustrating the operation of a screening unit.
Figure 5B:
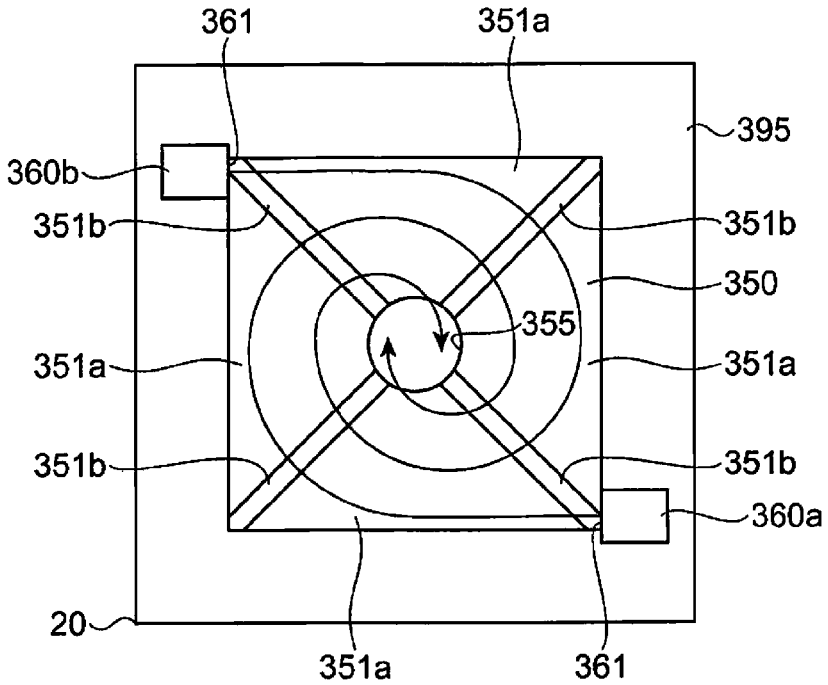

Furthermore, as illustrated in FIG. 2, a blowing unit 360 for blowing air to the interior of the transferring unit 350 is provided to the transferring unit 350 of the present embodiment. The blowing of air from the blowing unit 360 is intended to generate an air flow that swirls inside the transferring unit 350. As the means of blowing air of the blowing unit 360, the blowing unit 360 may be equipped with a fan, rotatingly drive the fan by a rotating means such as a motor, and thereby generate the blowing of the air, or a pump may be used to generate compressed air. The blowing unit 360 may be singular or there may be a plurality thereof. In the present embodiment, there are two blowing units 360 (360*a*, 360*b*) arranged. Respective air outlets 361 of the blowing units 360*a*, 360*b* are located above the middle of the vertical direction in the transferring unit 350. In the present embodiment, the air outlets 361 are arranged on a surface of the connecting plate 390 corresponding to the uppermost side of the vertical direction in the transferring unit 350. Therefore, the connecting plate 390 may also be regarded as a part of the transferring unit. One blowing unit 360*a* is arranged on the surface of the connecting plate 390 corresponding to one corner of the opening unit 391 of the transferring unit 350, and the other blowing unit 360*b* is arranged on a surface of the connecting plate 390 that is one corner of the opening unit 391 of the transferring unit 350 and is a position diagonal with respect to the position where the one blowing unit 360*a* is arranged. The air outlets 361 of each of the blowing units 360*a*, 360*b* are arranged so as to be able to blow air along the inner surface sections 351*a* provided to the same side with respect to the interior of the transferring unit 350. In this manner, providing the plurality of blowing units 360*a*, 360*b* makes it possible to blow air into a wide range of the interior of the transferring unit 350. In the present embodiment, the blowing units 360*a*, 360*b* cause a swirling air flow to flow in the interior of the transferring unit 350. More specifically, wind discharged from the air outlets 361 of each of the blowing units 360*a*, 360*b* flows to the lower side in the transferring unit 350 while also turning around and around like a whirlpool along the inner surface sections 351*a* and the curved surface sections 351*b* of the interior of the transferring unit 350, as illustrated in FIGS. 5A and 5B, ultimately flowing to the discharge port 355 of the lower end in the transferring unit 350. Borne of the air flow swirling through the transferring unit 350 interior, the fibers or the like can be transferred in an unencumbered manner from the upper side toward the lower side of the transferring unit 350 along the inclined inner surface sections 351*a* and curved surface sections 351*b*. In order to cause the swirling air flow to flow, it suffices to cause the air flow to flow so as to intersect with inclined lines, where the inclined lines defined as being trajectories by which a ball falls due to the force of gravity along the inclination of the inner surface sections 351*a* and the curved surfaces 351*b*. In a case where the air flow conversely were to flow along the inclined lines, there is a smaller range where the air flow is at work and therefore more blowing units become necessary. The fibers and the like can still be transferred in this manner, but having a swirling air flow makes it possible to reduce the number of blowing units.

The size of the cross-sectional area of an internal space of an upper side end in the vertical direction of the transferring unit 350 (referring to the size of the open mouth 352) is larger than the size of the cross-sectional area of an internal space of a lower side end in the vertical direction of the housing unit 400 (referring to the size of the open mouth 401). More specifically, as illustrated in the lateral cross-sectional view in FIG. 4, the width L2 of the internal space of the uppermost end in the transferring unit 350 is wider than the width L1 of the internal space of the lowermost end in the housing unit 400. In the direction perpendicular to the plane of the paper in FIG. 4, as well, the width of the internal space of the uppermost end in the transferring unit 350 is wider than the width of the internal space of the lowermost end in the housing unit 400. Because the transferring unit 350 is wider than the housing unit 400, the passed material can be transferred downward without being caught in the transferring unit 350. In a case where, conversely, the transferring unit 350 were to be less wide than the housing unit 400, then there would be a stepped difference formed more inward than the housing unit 400, and this stepped difference would end up causing the passed material to accumulate. Regarding the wind that is discharged from the air outlets 361 of each of the blowing unit 360*a*, 360*b*, the cross-sectional area of the internal space in the horizontal direction becomes smaller going from the upper end of the transferring unit 350 toward the lower end, and therefore the wind that is discharged from the air outlets 361 of the blowing unit 360*a*, 360*b* generates a greatly swirling air flow at the upper end of the transferring unit 350, becomes a gradually smaller swirl going from the upper end toward the lower end of the transferring unit 350, and flows to the discharge port 355.

Moreover, in the horizontal direction, the transferring unit 350 has protruding sections 395 located further outward than the housing unit 400, and the air outlets 361 are arranged at the protruding sections 395. In the present embodiment, the protruding sections 395 are provided to ends of the connecting plate 390, and the air outlets 361 of the blowing units 360*a*, 360*b* are provided to these protruding sections 395. As such, the air outlets 361 are arranged further outward than the inner wall surface of the housing unit 400, and therefore the passed material that is falling down from the sieve unit 300 will not accumulate at the air outlets 361. The air outlets 361 also do not protrude into the interior of the transferring unit 350. This, too, eliminates accumulation of the passed material falling down from the sieve unit 300 at the air outlets 361. Even when the air outlets 361 do protrude out into the interior of the transferring unit 350, it suffices for distal ends thereof to be arranged further outward than the inner wall surface of the housing unit 400.

Next, the operation of the screening unit shall be described. FIGS. 5A and 5B are descriptive diagrams illustrating the operation of the screening unit; FIG. 5A is a schematic diagram of a case where the screening unit is viewed from the side, and FIG. 5B is a schematic diagram of a case where the transferring unit of the screening unit is seen in plan view.

First, the classified material comprising fibers having been transferred via the tubing 203 from the classifying unit 40 is introduced to the interior of the sieve unit 300 from the introduction port 560 of the screening unit 50. Then, the rotation of the sieve unit 300 about the rotation center axis R causes the classified material that has been introduced to the sieve unit 300 to be screened into the passed material that passes through the openings 311 of the sieve unit 300 and the residual material that does not pass through the openings 311. The residual material that does not pass through the openings 311 is transferred to the defibrating unit 30 via the tubing 205 (see FIGS. 1 and 2).

The passed material having passed through the openings 311 of the sieve unit 300 descends towards the open mouth 401 of the lower end of the housing unit 400 (towards the opening unit 391 of the transferring unit 350). In turn, as illustrated in FIGS. 5A and 5B, wind is blown into the interior of the transferring unit 350 from the respective air outlets 361 of the blowing units 360*a*, 360*b* of the transferring unit 350. Specifically, wind that is oriented in a direction intersecting with the inclined lines and in the horizontal direction or downward direction is blown. The wind that is discharged from each of the air outlets 361 flows to the discharge port 355 of the downward side in the transferring unit 350 while turning around and around (swirling) like a whirlpool along the inner surface sections 351*a* and curved surface sections 351*b* of the interior of the transferring unit 350. The passed material having descended from the housing unit 400 side is flowed to the discharge port 355 while swirling through the transferring unit 350 interior in accordance with this air flow. The passed material discharged from the discharge port 355 is transferred to the depositing unit 70 side via the tubing 204.

According to the present embodiment above, the following effects can be obtained.

The passed material having passed through the openings 311 of the sieve unit 300 is sent to the transferring unit 350, which is located below the sieve unit 300. This transferring unit 350 is such that the cross-sectional area of an internal space in the horizontal direction decreases going downward. That is to say, the inner surface sections 351*a* and curved surface sections 351*b* of the transferring unit 350 are inclined going from the upper side toward the downward side of the transferring unit 350, and therefore the passed material that is sent to the transferring unit 350 is transferred while being collected from the upper side toward the downward side of the transferring unit 350. This suppresses occurrences such as where fibers that have adhered to the inner surface wall gather together and form a mass of fiber, and makes it possible to improve the efficiency of transfer of the passed material. Furthermore, the blowing of air generating an air flow that is discharged from the blowing units 360*a*, 360*b* and swirls through the inner surface sections 351*a* and curved surface sections 351*b* of the transferring unit 350 causes the passed material to ride on the air flow, thus allowing the passed material to be even more easily transferred.

The present invention is not limited to the embodiment described above, but rather a variety of modifications, improvements, or the like could be made to the embodiment described above. Modification examples shall be described below. The modification examples may be combined.

Modification Example 1

Figure 6:
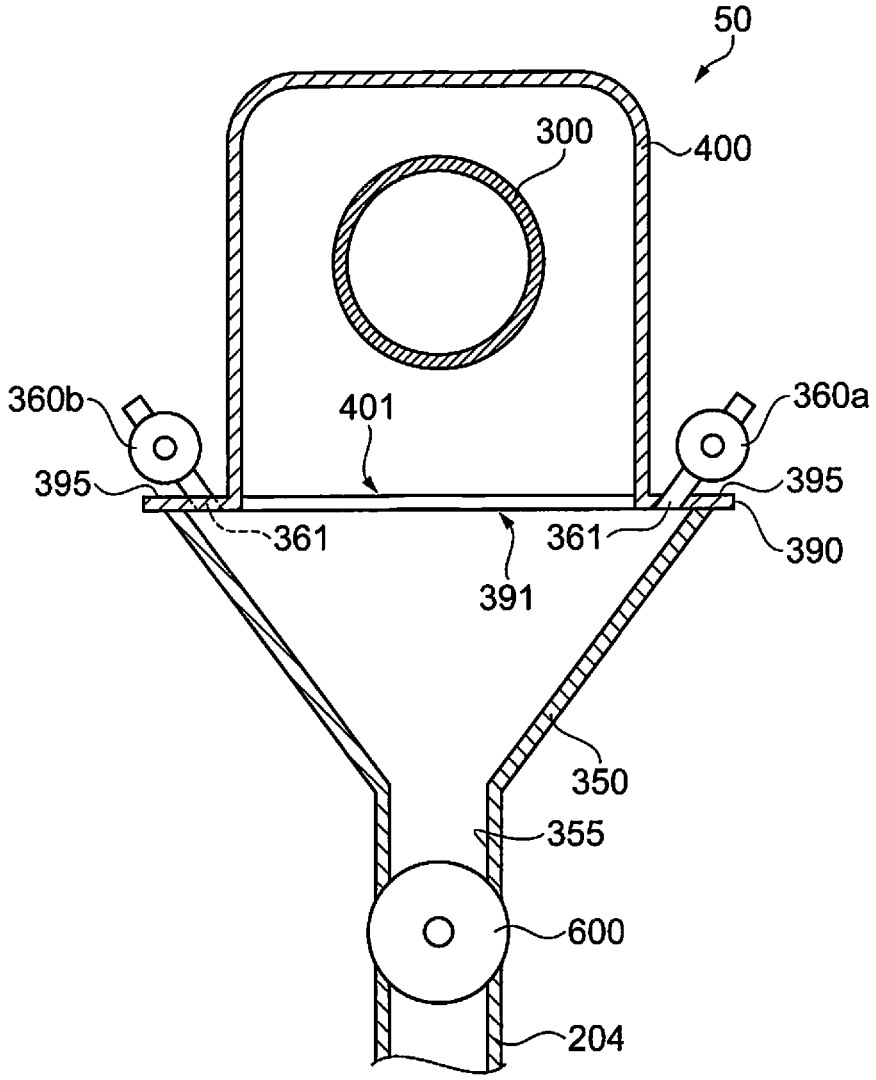
FIG. 6 is a schematic diagram illustrating the configuration surrounding a screening unit as in a modification example 1.

In the embodiment described above, the discharge port 355 of the transferring unit 350 and the tubing 204 were connected, but there is no limitation to being this configuration. For example, a blower may be further provided between the discharge port 355 and the tubing 204. This blower is for sending any passed material that has gathered to the downstream side. In the absence of the shape of the transferring unit 350 of the present application and in absence of the blowing units 360 thereof, even providing the blower will not make it possible to efficiently transfer the passed material. Even with downward suction with the blower, it will not be possible to produce an air flow that swirls inside the transferring unit; the air flow passing through the internal space will be greater than the air flow running along the inner wall surface, and it will not be possible to reduce adhesion of the passed material to the inner wall surface. FIG. 6 is a schematic diagram illustrating a configuration surrounding the screening unit as in the modification example 1. As illustrated in FIG. 6, a blower 600 for generating an air flow to the tubing 204 side from the transferring unit 350 is provided between the discharge port 355 of the transferring unit 350 of the screening unit 50 and the tubing 204. The generation of air flow by this blower 600 makes it possible to prevent passed material that has gathered (been transferred) to the discharge port 355 side of the transferring unit 350 from being retained in the vicinity of the discharge port 355; rather, the passed material can be efficiently transferred to the tubing 204 side. In such a case, the amount of wind from the blowing units 360*a*, 360*b* would be set within a range that does not exceed the amount of wind of the blower 600. For example, the amount of wind from the blowing units 360*a*, 360*b* is set to about 1/10 the amount of wind of the blower 600. So doing makes it possible to reduce retention of the passed material at the discharge port 355, and possible to suppress the occurrence of masses of fiber or the like.

Modification Example 2

Figure 7A:
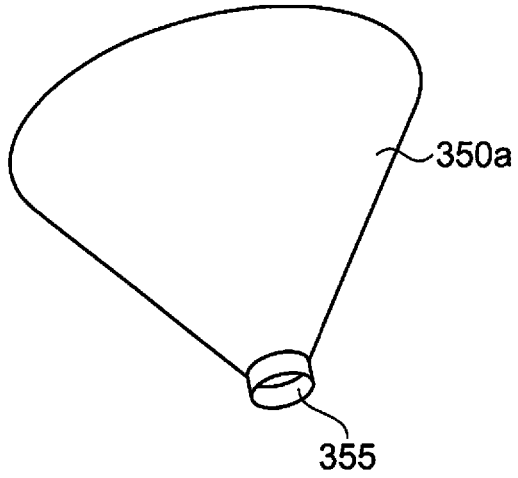
FIGS. 7A-7C are schematic diagrams illustrating the configuration of a transferring unit as in a modification example 2.
Figure 7B:
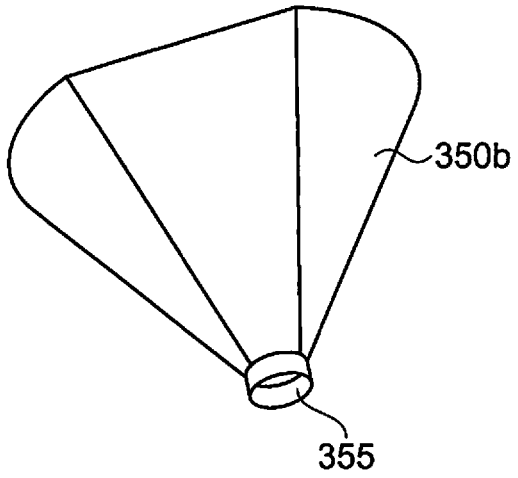
Figure 7C:
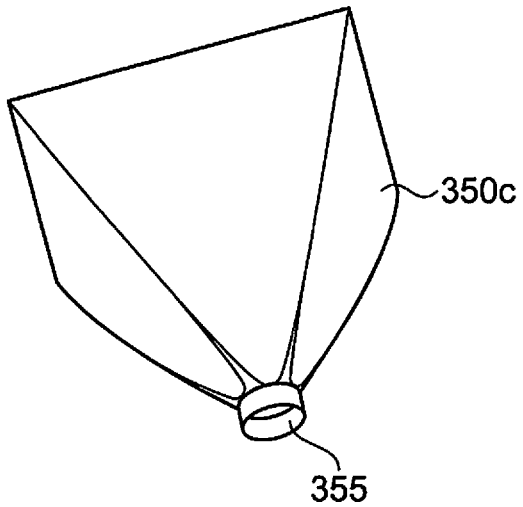

In the embodiment described above, the transferring unit 350 was understood to have the shape of substantially a quadrangular pyramid, but there is no limitation to being this shape. FIGS. 7A-7C are schematic diagrams illustrating configurations of transferring units as in a modification example 2. For example, as illustrated in FIG. 7A, the transferring unit may be a transferring unit 350*a* having a substantially conical shape. As illustrated in FIG. 7B, the transferring unit may be a transferring unit 350*b* with which one side of two opposing sides out of substantially a quadrangular pyramid take an arcuate shape. As, as illustrated in FIG. 7C, the transferring unit may be a transferring unit 350*c* (rounded hopper) that has substantially a rounded-corner shape and an inclination angle that is not constant. Effects similar to the effects described above can still be obtained in this manner.

Modification Example 3

In the embodiment described above, the blowing unit 360*a* and the blowing unit 360*b* were arranged at equal intervals, but there is no limitation thereto, and the arrangement need not be at equal intervals. Effects similar to the effects described above can still be obtained in this manner.

Modification Example 4

In the embodiment described above, there were the two blowing units 360*a*, 360*b* arranged, but there is no limitation thereto, and there may be one blowing unit, or three or more blowing units may be arranged. In such a case, the setting would be made as appropriate, taking the scale of the screening unit 50, the amount of fibers being transferred, and the like into consideration. So doing makes it possible to transfer the fibers efficiently.

Modification Example 5

With the blowing units 360*a*, 360*b* of the embodiment described above, ordinary air was discharged, but there is no limitation thereto. For example, ionized air may be blown. With this, ionized air sprayed onto the fibers causes the fibers, which have been charged, to be electrostatically discharged. This reduces adhesion of the fibers to the inner surface sections 351*a* or curved surface sections 351*b* of the transferring unit 350, and makes it possible to transfer more efficiently.

Modification Example 6

The embodiment described above assumed a wall surface that is downwardly inclined at all times to the discharge port 355 from the open mouth 352 of the transferring unit 350. There is no limitation thereto, and a vertical section or a horizontal section may be provided to a part of the inner wall surface. In such a case, the fact that "the cross-sectional area of an internal space in the horizontal direction decreases going downward" would refer to the portion more upward than the vertical section or horizontal section.

Modification Example 7

In the embodiment described above, the housing unit 400 covered a part of the sieve unit 300; however, the entirety of the sieve unit 300 may be covered.

Modification Example 8

In the embodiment described above, the housing unit 400 and the transferring unit 350 were connected together with the connecting plate 390 interposed therebetween. There is no limitation thereto, and the housing unit 400 and the transferring unit 350 may be connected directly, without the connecting plate 390 being interposed therebetween. For example, the housing unit 400 and the connecting plate 390 may be integrated together. In such a case, the blowing units 360 would be attached to the housing unit 400 and therefore the blowing units 360 may be provided with a sieve unit.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A sheet manufacturing apparatus comprising:

a defibrating unit configured to defibrate a stock material including fibers;

a screening unit including a housing, a sieve unit having a plurality of openings configured to allow passage of a defibrated material that has been defibrated at the defibrating unit, the sieve unit having a drum-shape and being rotatably supported by the housing, a transferring unit located in a first direction relative to the housing and the sieve unit and configured to transfer a passed material that has passed through the openings, the transferring unit having an inner surface that defines an internal space in which the passed material is transferred, a cross-sectional area of the internal space in a second direction decreasing as being apart from the housing in the first direction, the second direction being perpendicular to the first direction and the axial direction of rotation of the sieve unit, and a blowing unit configured to blow air into the internal space of the transferring unit, the blowing unit having an air outlet located closer to the housing unit than a middle section in the first direction of the transferring unit; and a forming unit configured to form a sheet by using the passed material that has been transferred by the transferring unit.

2. The sheet manufacturing apparatus as set forth in claim 1, wherein the blowing unit is configured to blow the air such that the air generates an air flow that swirls through the internal space of the transferring unit.

3. The sheet manufacturing apparatus as set forth in claim 1, wherein the screening unit has a plurality of blowing units configured to blow the air into the internal space of the transferring unit.

4. The sheet manufacturing apparatus as set forth in claim 1, wherein the housing unit covers the sieve unit such that the openings are included in an interior thereof, a size of a cross-section of the internal space of an upper side end in the first direction in the transferring unit is greater than a size of a cross-section of an internal space of a lower side end in the first direction in the housing unit.

5. The sheet manufacturing apparatus as set forth in claim 1, wherein the transferring unit has a protruding section located further outward than the housing unit in at least the second direction, and an air outlet of the blowing unit is arranged at the protruding section.

6. The sheet manufacturing apparatus as set forth in claim 5, wherein the protruding section has a plate shape, contacts the housing, and is arranged between the housing and the transferring unit in the first direction.

7. The sheet manufacturing apparatus as set forth in claim 1, wherein the housing unit includes a plurality of side walls defining an interior portion to accommodate the sieve unit, and includes an opening portion to allow passage of the passed material that has pass through the openings toward the transferring unit, and a length in the second direction of the opening portion is smaller than a length in the second direction of a portion of the internal space of the transferring unit, and the portion of the internal space is disposed closest to the housing in the first direction.

* * * * *